United States Patent [19]

Kuras

[11] Patent Number: 5,075,137

[45] Date of Patent: Dec. 24, 1991

[54] METHOD OF WEATHERING MODELS

[76] Inventor: Leonard C. Kuras, 112 Point Lobos, San Francisco, Calif. 94121

[21] Appl. No.: 424,756

[22] Filed: Oct. 20, 1989

[51] Int. Cl.[5] ..... B05D 5/00; B05D 1/36

[52] U.S. Cl. ..... 427/204; 427/205; 427/262; 427/267; 427/280

[58] Field of Search ..... 427/260, 262, 267, 204, 427/258, 202, 205, 280, 265

[56] References Cited

U.S. PATENT DOCUMENTS

| | | | |
|---|---|---|---|
| 2,351,717 | 6/1944 | Sott | 427/240 |
| 4,317,847 | 3/1982 | Batistelli | 427/262 X |
| 4,416,940 | 11/1983 | Loye et al. | 427/267 X |

OTHER PUBLICATIONS

Hawley, G. G., "The Condensed Chemical Dictionary", New York, Van Nostrand Reinhold Company, 1977.

*Primary Examiner*—Evan Lawrence

*Attorney, Agent, or Firm*—Flehr, Hohbach, Test, Albritton & Herbert

[57] ABSTRACT

A method of weathering a model of an object is described. The model to be weathered most desirably is a hobbyist model, such as used by model railroaders and military modelers, and it is rust that is simulated. A suspension of a rust-colored coloring agent is applied to the surface of the model within a carrier which is adapted to spread the same as flakes over the surface. The carrier is then removed by drying the model to leave the flakes. A second coloring agent of a different color is applied to the model over the dried flakes to enhance weathered appearance.

11 Claims, No Drawings

METHOD OF WEATHERING MODELS

BACKGROUND OF THE INVENTION

This invention relates to the weathering of, and application of rust simulation to, models of objects such as those designed for model railroading and the like, and a rust simulator for the same.

Model railroaders and military modelers often wish to weather their models. For example, a hobbyist interested in assembling a model railroad will often wish to provide "rust" and the like on models of metal objects typically found in a train environment. In some instances the hobbyist may desire to add a weathered appearance to model railroad locomotives.

SUMMARY OF THE INVENTION

The present invention provides methods of simulating weathering and rust on the model of an object to provide a highly realistic appearance. It is applicable to models irrespective of the base material of which they are made, e.g., a plastic. In summary, the method includes the application to a model, of a coloring agent, such as a paint pigment, suspended in a surface dispersant (a carrier), such as isopropyl alcohol. Most desirably, the surface dispersant is one which will separate the coloring agent into small particulate flakes simulating rust flakes. The suspension is allowed to dry, leaving rust particulate matter. It's application to the model is repeated if a deeper rust color is desired. A second coloring agent, typically a darker one, is then most desirably added to bring out detail and texture on the "rust". This agent is most easily provided as a mixture with water, and a small amount of a surfactant is added to assure appropriate wetting of the surface.

After the second coloring agent is dried, a protective coating is applied to the model. Moreover, a fine powder of dust can be added as desired for a more realistic appearance. The invention also includes a relatively inexpensive rust simulator whose application to a model has been found to provide the desired rusted appearance.

DETAILED DESCRIPTION OF THE PREFERRED EMBODIMENTS

Typically, before a model is weathered in accordance with the invention it is first painted or otherwise coated to provide a prime base coloring which simulates the coloring of the object being modeled before it has been weathered. For example, while most models simulating metal objects should have a dark, flat gray primer applied to the same, locomotive models generally are treated with a flat black base prime coat. Models of military equipment may have a base primer that is an olive drab, panzer gray, or desert color. The article to be treated then has a suspension of a rust-colored coloring agent and a surface dispersant applied to the same. The coloring agent preferably and most simply can be provided as a latex based paint having a color pigment providing the desired color. (It is has been found that a "burnt sienna" color is generally of the same color as true rust.) The paint is mixed with a liquid which will suspend the coloring pigment as small particulate material or flakes. As mentioned previously, isopropyl alcohol has been found to be a quite satisfactory medium. It separates a coloring pigment into desirably sized flakes. A suitable mixture is one having approximately 10 to 25 percent of paint to isopropyl alcohol. Most desirably, the paint and alcohol are mixed together prior to application to the model so that pre-separation is provided. The mixture is stirred to assure that the suspended particles are relatively evenly distributed in the same, and then applied to the model to be "rusted". Such mixture is then dried Although accelerated drying could be used, most simply and easily the model with the coloring agent suspension applied to the same, is allowed to dry merely by exposing the same to air at ambient temperature and pressure. After it is dried, the application step can be repeated if a deeper coloring is desired.

For a realistic weathered appearance, it is preferable that another coloring agent of a darker color is applied to the model over the "rust" layer. It is applied to enhance the weathering by darkening the rust and bringing out detail and texture. The second coloring agent is also desirably a latex paint, typically one having a black or near black color pigment. It is provided as a mixture of approximately 10–20% with water and a small amount (a two per two ounces of mixture) of a surfactant. This mixture is applied similarly to the suspension discussed above. Again, several coats can be applied to achieve a desired darkening. Moreover, each of the coatings should be dried before further coatings or further treatment Air drying as above is quite appropriate. Any drops of liquid that may appear as the coating dries should be removed. In this connection, it should be kept in mind that drops sometimes appear in view of the incompatibility of water with isopropyl alcohol.

A protective coating is then preferably applied to cover the weathering. Such coating most desirably is provided by a material which will provide a flat finish. It can be, for example, a 10% mixture of a simple white glue and water. In this connection, the glue sold under the trademark "Elmers" has been found to be quite satisfactory.

In many situations, to provide a realistic weathering appearance it is desirable to make the model appear dirty, or mud caked. To this end, it is desirable to apply to the model after the application of the protective coating, a clay which has been sifted to be a fine powder made up of particles having the small sizes typically associated with talcum. If a mud-caked appearance is desired, the clay particles can be applied before the protective coating is completely dry. At such time, the protective coating will have adhesive qualities, with the result that the dust in coagulated form will be adhered to the model. If it is simply desired to add a "dirty" look to the model, the powder most desirably is applied after the protective coating has dried. Moreover, most desirably the model is lightly brushed after the application of the powder to remove any excess.

Although the invention has been described in connection with a preferred embodiment thereof, it will be appreciated by those skilled in the art that various changes and modifications can be made. It is therefore intended that the coverage afforded applicant be limited only by the claims and their equivalents.

I claim:

1. In a method of weathering a model of an object, the steps comprising:

(a) applying to a surface of said model, a suspension of a rust-colored coloring agent within a carrier adapted to spread the same as flakes over said surface;

(b) and thereafter removing said carrier by drying said model to leave said flakes.

2. The method of claim 1 wherein said rust-colored coloring agent is a paint pigment and said carrier is adapted to separate said pigment into said flakes, further including the step prior to said step of applying, of mixing said paint pigment and said carrier so as to provide said flakes.

3. The method of claim 2 wherein said carrier is a liquid and said step of drying comprises exposing said surface having said flakes and carrier thereon to air at ambient temperature and pressure.

4. The method of claim 1 wherein said step of applying includes applying to said model as said suspension, a mixture make up of said coloring agent comprising a latex based paint having a pigment, and isopropyl alcohol as said carrier.

5. The method of claim 1 further including after said step of drying, of applying a second coloring agent of a different color to said model over said first coloring agent to enhance the weathered appearance of said model.

6. The method of claim 5 wherein said second coloring agent is applied to said model mixed with water, further including the step of subjecting said model to a second drying operation to remove said water.

7. The method of claim 5 further including the step of applying a protective coating to said surface over said flakes and said coloring agent.

8. The method of claim 7 wherein said protective coating is a mixture of an adhesive and water, further including the step after the application of said protective coating mixture of drying water from said protective coating.

9. The method of claim 7 further including the steps of applying dust to said protective coating and thereafter brushing excess dust from said coating.

10. In a method of simulating rust on a model of an object, the steps comprising:

applying to a surface of said model a suspension of a rust-colored paint pigment in a liquid carrier;

drying said suspension to remove said carrier;

applying a mixture to said model where said pigment has been applied, said mixture being one of water, a second coloring agent and a surfactant, to provide visual contrast and enhancement to the visual appearance of said surface of said model;

drying said mixture;

applying a protective coating to areas of said surface having said suspension and mixture applied thereto; and thereafter applying a fine powder of earth to said surface.

11. The method of claim 10 further including the step of removing excess powder from said surface.

* * * * *